United States Patent [19]

Ortman et al.

[11] Patent Number: 4,984,315

[45] Date of Patent: Jan. 15, 1991

[54] PREGNANCY PILLOW WITH INFLATIBLE BLADDER

[76] Inventors: Chet B. Ortman; Jennifer L. Ortman, both of 712 11th Ave. N.E., Wenatchee, Wash. 98802

[21] Appl. No.: 531,638

[22] Filed: Jun. 1, 1990

[51] Int. Cl.[5] ..... A47C 27/08; A47G 9/00

[52] U.S. Cl. ..... 5/431; 5/441

[58] Field of Search ..... 5/441, 454, 431, 448, 5/464, 447, 436; 297/DIG. 3

[56] References Cited

U.S. PATENT DOCUMENTS

| | | | |
|---|---|---|---|
| 655,087 | 7/1900 | Jones | 5/441 |
| 795,108 | 7/1905 | Doellinger | 5/441 |
| 3,411,164 | 11/1968 | Sumergrade | 5/441 |
| 4,382,306 | 5/1983 | Lickert | 5/441 |
| 4,397,052 | 8/1983 | Lund | 5/431 |
| 4,501,034 | 2/1985 | Greenwalt | 5/441 |
| 4,506,396 | 3/1985 | Ritchie | 5/431 |
| 4,528,705 | 7/1985 | Greenawalt | 5/441 |
| 4,789,202 | 12/1988 | Alter | 297/DIG. 3 |
| 4,805,603 | 2/1989 | Cumberland | 5/441 |
| 4,829,614 | 5/1989 | Harper | 5/441 |

*Primary Examiner*—Alexander Grosz

*Attorney, Agent, or Firm*—Russell W. Illich

[57] ABSTRACT

A pillow is provided for use by a woman during pregnancy. The pillow comprises a polyfill core having an adjustable bladder within one end of the pillow. The bladder may receive air through a hand pump so that the pillow may be adjusted to a woman's shape depending upon how the pillow is to be used. When the bladder is fully deflated, the pillow is of an oblong shape in elevation. When the bladder is filled with air, the pillow takes on an L-shaped elevation that can more closely hug a woman's body in certain lying and sitting positions. The bladder also includes a valve for holding or releasing the air from the pillow.

3 Claims, 1 Drawing Sheet

PREGNANCY PILLOW WITH INFLATIBLE BLADDER

BACKGROUND OF THE INVENTION

The present invention relates to a pillow for use by women who are pregnant. There are currently a number of pillows specifically designed for pregnant women to aide in relieving the stress involved in routine activities such as resting, reclining and sleeping. Although these devices do fulfill their function in a limited manner, there are many improvements to be made upon these type of pillows. First, none of these pillows are fully adjustable for women of various sized frames nor are they adaptable for different stages of the pregnancy. Generally, they include some type of aperture or projection for lower support of the woman's abdomen, but they fail to be very adaptable to any position except the sleeping position.

SUMMARY OF THE INVENTION

It is an object of this invention to provide a pillow that is adjustable to a variety of contours depending upon the frame of a woman.

Another object the invention is to provide a pillow that may be used in a variety of positions while lying down or sitting up.

It is a further object of the invention to provide a pillow that is simple in design, easy to use, and easy to manufacture.

Other objects of the invention will be apparent hereinafter from the specification and from the recital of the appended claims, particularly when read in conjunction with the accompany drawings.

The present invention comprises a polyfil core pillow having an adjustable bladder within one end of the pillow. The bladder may receive air through a hand pump so that the pillow may be adjusted to a woman's shape depending upon how the pillow is to be used. When the bladder is fully deflated, the pillow is of an oblong shape. When the bladder is filled with air, the pillow takes on an L-shape that can more closely hug a woman's body in certain lying and sitting positions. The bladder also includes a valve for holding or releasing the air from the pillow.

DETAILED DESCRIPTION OF THE INVENTION

Figure 1:
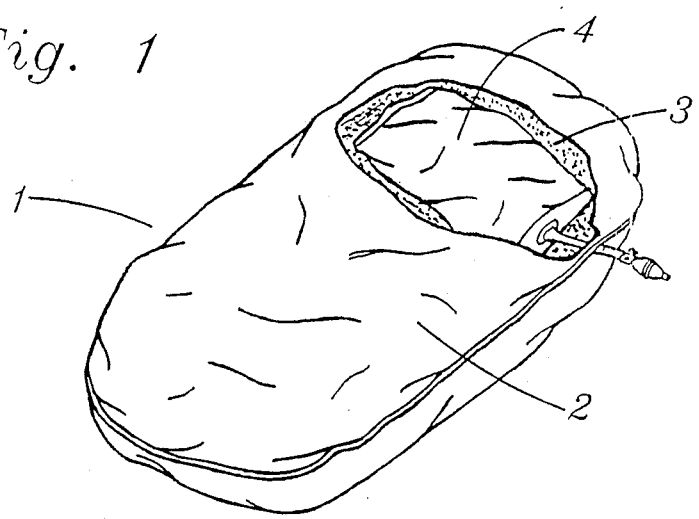
FIG. 1 shows a partially cut away perspective view of the pillow of the present invention.
Figure 2:
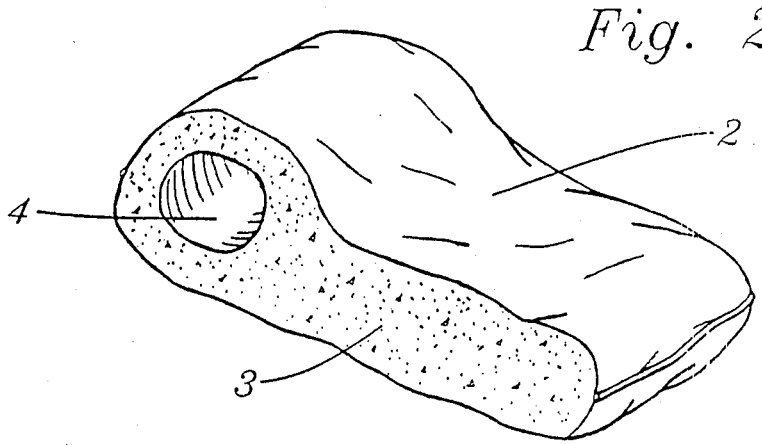
FIG. 2 shows a cross section of the pillow of FIG. 1 to reveal its interior.

FIG. 1 shows the preferred embodiment of the pregnancy pillow of the present invention. The pillow 1 includes an exterior shell 2 made of an outer cloth cover that is stitched together around its entire periphery. The interior of the pillow contains a polyfill core 3 which is distributed evenly thoughout the entire pillow to give the pillow its oblong shape, as shown in FIG. 1. Within one end of the pillow is a bladder 4. The bladder is disposed within the polyfill core and is entirely surrounded by polyfill, as best seen in FIG. 2.

Figure 3:
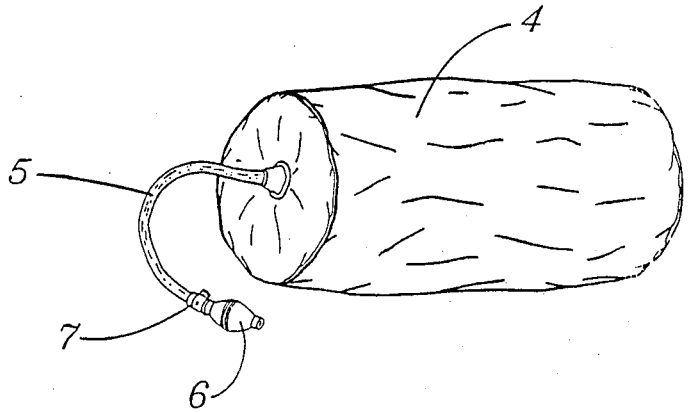
FIG. 3 shows a perspective view of the bladder used in the present invention.

FIG. 3 shows details of the bladder 4. The bladder includes an air tight outer cover that is connected to a hose 5 for allowing air to pass in and out of the bladder. The hose 5 is connected to the bladder at one end and is connected to a pump 6 at an opposite end. FIG. 1 shows the hose extending through an opening of the shell 2 of the pillow to be connected to the exterior pump. The pump in FIG. 3 is shown as a conventional hand operated pump. The pump also includes a conventional valve 7 for allowing the pump 6 to inject air into the bladder in a closed positionn and for releasing air from the bladder in an open position.

FIG. 1 shows the pillow in a normal or deflated shape. In this shape, the pillow appears oblong in elevation and is not distinguisable from any other polyfill core pillow. FIG. 2 shows the pillow in a fully inflated condition such that the pillow appears L-shaped in an elevation or side view. FIG. 2 shows the bladder 4 stretched to its fully inflated condition to form a smooth and round projection at one end of the pillow. The fully inflated and deflated shapes represent the extremes in a continuous range of adjustable sizes of the projection.

In use, the pillow is very versatile allowing a woman to rest comfortably in a variety of positions. A first position would involve the woman resting on her stomach such that her upper body is supported by the round projection while her lower body lies upon the lower or non-inflated portion of the pillow. With conventional pillows, the pillows must be folded back or bunched up so that the woman's upper body receives support without putting undue pressure on the womb while lying on her stomach. Conventional pillows in this type of configuration will often shift out of positon while used during sleep causing the woman physical discomfort. With the pillow of the present invention, the woman merely pumps air into the bladder until she feels comfortable with the support she receives from the pillow. It should be noted that the pillow is adjusted depending on the frame of the woman and the stage of her pregnancy.

The pillow may also be used when a woman is resting on her side. In this position, the round projection is likely to be positioned further down on a woman's body so that the womb may be partially supported by the beginning of the projection with her upper leg resting on top of the projection. In the side position it is likely that the woman will not want as much air in the bladder as in the stomach position. In this case, the valve 7 makes it easy to release air from the pillow if the woman shifts to the side position during sleep. The projection also can give support to a woman's legs when resting on her back.

During the day the pillow 1 may be used in a variety of positions. For example, when lying down on the floor to watch television or read a book, a woman can use the fully inflated pillow of FIG. 2 to give her upper body support. The pillow can also be used when the woman is doing aerobic or stretching exercises. The convenience of the pump 6 and valve 7 allows the woman to easily configure the pillow to conform to a specific exercise position.

In a sitting position, the pillow 1 can give added support to a pregnant woman while reclining in a chair or couch. In this case, the pillow is positioned behind the woman such that the inflated and round projection lies against her lower back while the rest of the pillow lies behind her upper back. The weight of carrying a baby to term can cause stress and strain within a woman's lower back. Thus, the pillow of the present invention helps to support a woman's lower back while in a sitting position. Generally, in use, the bladder is never fully inflated with air, as shown in FIG. 2. For comfort purposes, the bladder is usually only partially filled with air to allow the projection to contour to the woman's body.

It can be seen from the variety of uses given above, that the pillow's adjustability is key in allowing it to be used in a wide variety of configurations. The ease at which the pillow may be adjustable make the pillow unique from the prior art. Another key feature of the pillow is its capability to be used as a normal pillow in its deflated condition, as shown in FIG. 1. Thus, the pillow may be used by anyone at anytime. Specialized pregnancy pillows are generally not used as normal pillows because of their odd shapes.

The exterior shell 2 of the pillow may be made of any suitable material such as cotton, vinyl, etc. Generally, the material should be a strong fabric so that the pillow can be used on the floor, on various chairs, etc. The core 3 should be made of a polyfill that is a conventional material in the manufacture of pillows. The bladder 4 should be made of a resilient rubber and should be sealed together in one air-tight piece. The bladder may resemble a beach ball in configuration. The hose, pump and valve can be of a conventional air pump design using a combination of rubber, plastic, and/or metal parts. It should be noted that one modification of the invention could involve providing the bladder with a disconnectable hose and pump that could be replace with a plug. This would allow the pillow to be entirely indistinguishable from a normal pillow when the plug is in place, yet still allow the pillow to be configured as a pregnancy pillow when so desired.

It should be apparent that many modifications could be made to the pregnancy pillow which would still be encompassed within the spirit of the present invention. It is intended that all such modifications may fall within the scope of the appended claims.

What is claimed is:

1. A pillow for use during a woman's pregnancy comprising:

an oblong exterior shell, having two generally parallel longer sides, two generally parallel shorter sides, and generally parallel top and bottom sides, said shell forming an enclosed structure;

an interior core, said core formed of a polyfill material that is distributed evenly throughout said enclosed structure of said shell;

a sole elongated bladder, said bladder positioned adjacent one end of said pillow, proximate one of the shorter sides of said shell, and extending between and proximate to said longer sides, said bladder being contained within said interior core, said bladder forming an inner compartment within said pillow, said bladder being surrounded by said polyfill material;

means for injecting air into said bladder such that a smooth and round projection is formed at one end of said pillow by said inner compartment;

means for releasing air from said bladder;

said pillow being adjustable in a continuous range of shapes between two extreme shapes, a first extreme shape being substantially L-shaped in elevation, wherein said bladder is fully inflated with air and said projection is largest, and a second extreme shape, substantially oblong in elevation, wherein said bladder is deflated and said pillow has flat top and bottom sides;

wherein, said pillow may be adjusted to a particular woman's shape and form by injecting air into or releasing air from said bladder.

2. A pillow as claimed in claim 1, wherein, said means for injecting air into said bladder comprises a hose with one end connected to said bladder and an opposite end extending out of said shell, said air injection means further comprising a hand operated pump connected to said opposite end of said hose for advancing air through said hose and into said bladder.

3. A pillow as claimed in claim 1, wherein, said means for releasing air from said bladder comprises a valve capable of moving between two positions, a first open position for allowing air to move into or release from said bladder, and a closed position for restricting the passage of air to or from said bladder.

* * * * *